United States Patent [19]

Carter

[11] 4,188,673

[45] Feb. 19, 1980

[54] ROTATABLE POP-UP WATER DELIVERY HEAD FOR POOL CLEANING SYSTEMS

[76] Inventor: Heard L. Carter, 1121 N. Hayden Rd., Scottsdale, Ariz. 85257

[21] Appl. No.: 950,461

[22] Filed: Oct. 11, 1978

[51] Int. Cl.[2] ..... E04H 3/20; B08B 3/02; B08B 9/00

[52] U.S. Cl. ..... 4/172.17; 134/167 R; 239/206; 239/251

[58] Field of Search ..... 4/1, 145, 172, 172.15, 4/172.16, 172.17; 134/167 R, 168 R; 239/66, 67, 204, 206, 240, 251

[56] References Cited

U.S. PATENT DOCUMENTS

| | | | |
|---|---|---|---|
| 2,509,076 | 5/1950 | Royer | 239/240 X |
| 3,117,724 | 1/1964 | Ray | 239/206 X |
| 3,149,784 | 9/1964 | Skidgel | 239/206 |
| 3,449,772 | 6/1969 | Werner | 134/167 R |
| 3,506,489 | 4/1970 | Baker | 4/172 X |
| 3,616,468 | 11/1971 | Takacs | 4/172.15 |
| 3,675,252 | 7/1972 | Ghiz | 4/172.17 |
| 3,782,630 | 1/1974 | Sabo | 239/206 X |
| 3,955,764 | 5/1976 | Phaup | 239/206 |

*Primary Examiner*—Stuart S. Levy
*Attorney, Agent, or Firm*—Warren F. B. Lindsley

[57] ABSTRACT

A swimming pool mounted rotatable head for a water jet pool cleaning system adapted to rotate in a non-uniform sequential manner during a pool cleaning operation to maintain deleterious matter in suspension in the water so that it may be removed by the main drain or skimmer inlets of the pool water circulation system.

2 Claims, 5 Drawing Figures

ROTATABLE POP-UP WATER DELIVERY HEAD FOR POOL CLEANING SYSTEMS

BACKGROUND OF THE INVENTION

This invention relates to a swimming pool cleaning system and more particularly to a swimming pool cleaning system, wherein a plurality of rotary jet nozzles are disposed adjacent inner surfaces of the pool to wash the inner surfaces, and also to maintain deleterious matter in suspension in the water so that it may be carried outward through the main drain or the skimmer inlets of the pool water circulating apparatus.

Many devices and methods have been used for cleaning deleterious matter from the interior of a swimming pool. Some of them include manually operated vacuum pickups, others include snake-like water jets tubes of flexible character which operate in a generally sinusoidal movement, and rub the bottom of the pool while moving around and creating jet streams along the inner surfaces of the pool.

Other prior art devices have included nozzles adjacent the inner surfaces of the pool structure, and these nozzles have been unidirectional or monodirectional, and have been partially successful; however, most prior art pool-cleaning systems have required a substantial amount of attention, labor, and/or maintenance.

DESCRIPTION OF THE PRIOR ART

U.S. Pat. No. 3,675,252 discloses a system for cleaning the inner surface of a swimming pool employing a rotary jet delivery head adapted to constantly rotate 360 degrees.

U.S. Pat. No. 3,616,468 discloses a radial tube which is rotatable about a vertical axis at the pool center adjacent the pool bottom to prevent debris from collecting on the pool bottom.

U.S. Pat. No. 3,449,772 discloses an automatically cycling swimming pool cleaning system wherein automatically extending and retracting water driven jets are rotated slowly about two revolutions per minute in discrete increments through the intermittent impact imparted to the nozzle by a circulating ball carried by a stream of water in route to the nozzle of the cleaning head.

SUMMARY OF THE INVENTION

In accordance with the invention claimed, an improved and greatly simplified rotary water dispensing pop-up head for a water delivery and pool cleaning system is provided which rotates in a non-uniform sequential manner to maintain deleterious matter in suspension in the water so that it may be removed by the pool water circulating system.

It is, therefore, one object of this invention to provide a new and improved rotatable pop-up water delivery head for a pool cleaning system.

Another object of this invention is to provide a new and improved rotatable pop-up water delivery head disposed adjacent the inner surface of the pool for washing the interior pool surfaces, the water pressure to which is interrupted periodically to cause the jet dispensing portion of the head to rotate in non-uniform arcuate amounts.

A further object of this invention is to provide a new and improved pop-up rotatable water jet delivery head which delivers a jet stream of recirculated water at an acute angle with the adjacent surface of the pool and at sequentially different arcuate positions with the rotating axis of the head.

A still further object of this invention is to provide a new and improved pop-up rotating jet producing head which rotates under the action of the varying pressure of the water recirculating system of the pool in non-uniform arcuate angles without any gears or other angularly movement controlling mechanisms.

A still further object of this invention is to provide a novel swimming pool cleaning system employing a plurality of improved rotary jet delivery heads.

A still further object of this invention is to provide an economically producible and efficiently operable novel rotary jet delivery means for a swimming pool recirculating water system which will maintain foreign matter in suspension until it is collected by the swimming pool filtering system.

Further objects and advantages of the invention will become apparent as the description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
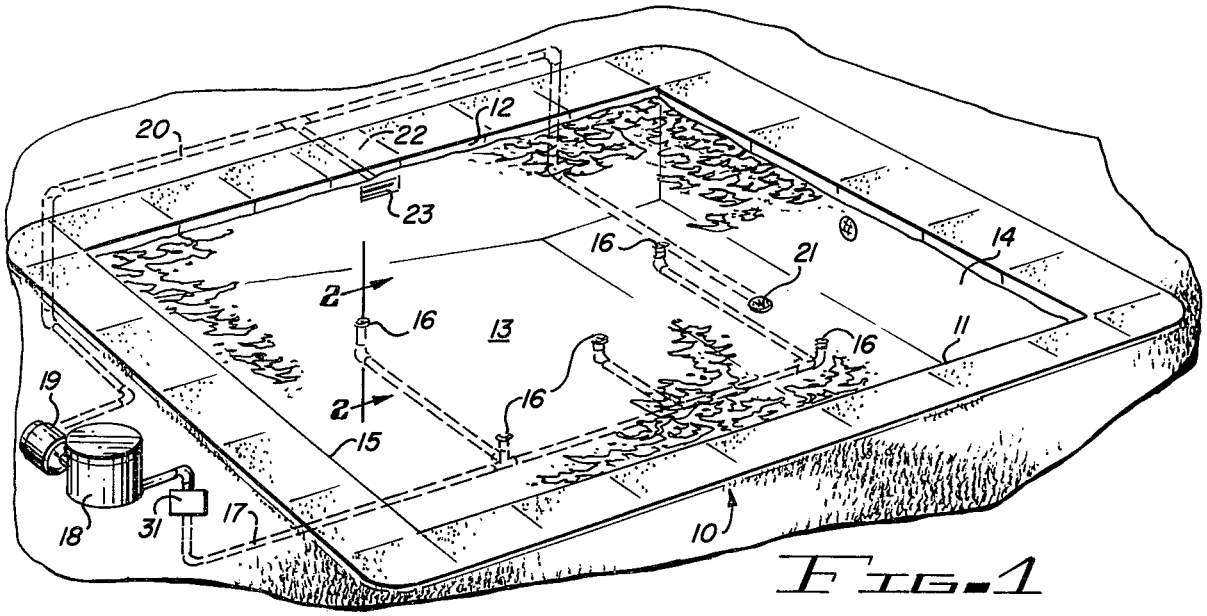
FIG. 1 is a fragmentary perspective view showing a swimming pool with a water circulating and filtering means employing jet dispensing rotary heads embodying the invention.

Referring more particularly to the drawing by characters of reference, FIG. 1 discloses diagrammatically a swimming pool structure 10 having inner side surfaces 11 and 12, a bottom surface 13 and end surfaces 14 and 15. Embedded in the side, bottom and end surfaces 11–15, respectively are a plurality of water jet delivery assemblies 16, hereinafter described in detail.

Communicating with each of the jet delivery assemblies is a conduit 17 adapted to deliver the water under pressure necessary to operate the rotary jet assemblies. This conduit 17 is disposed to communicate with the outlet of a filter 18. An electric motor driven pump assembly 19 delivers water under pressure to the filter and receives water through a conduit 20 communicating with a main drain 21 and with a conduit 22 communicating with a skimmer 23.

Pump assembly 19 pulls water from main drain 21 and skimmer 23 and forces it through filter 18 and conduit 17 to the rotary jet delivery assemblies 16.

Figure 2:
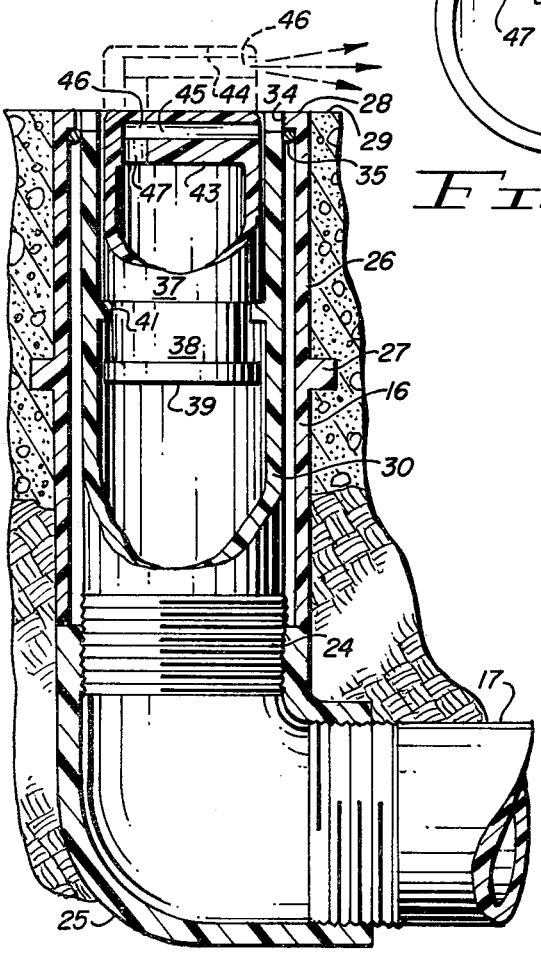
FIG. 2 is a cross-sectional view of FIG. 1 taken along the line 2—2.
Figure 3:
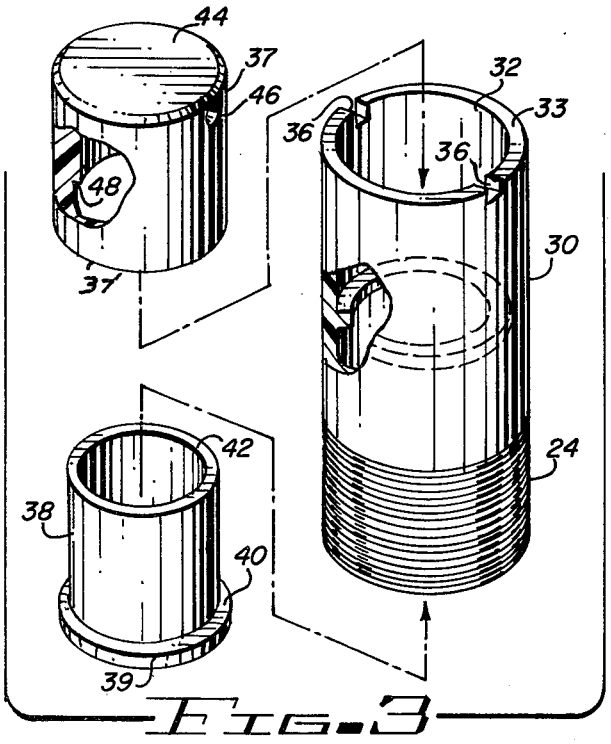
FIG. 3 is an exploded perspective view of the jet dispensing rotary head of the pool cleaning system shown in FIG. 2.

As shown in FIGS. 2 and 3, the rotary jet delivery assembly 16 comprises a plumbing connection end 24 adapted to be connected to conduit 17 by conventional plumbing fittings such as an elbow coupling 25. Suitably mounted to or on the coupling 25 is a shell or cylindrical hollow housing 26 within which the remaining parts of the rotary jet delivery assembly 16 are detachably mounted.

As shown in FIG. 2, housing 26 is provided with a flange 27 extending around its outer periphery at a suitable point between its ends to anchor the housing in the pool walls with its exposed end 28 arranged substantially flush with the interior surface 29 of the pool.

The assembly further comprises a generally cylindrical housing 30 the threaded end 24 of which is adapted to be connected to coupling 25 with coupling 25 being connected to the outlet ends of conduit 17 communicating with filter 18 through an on/off pump assembly pulser valve or interrupting means 31. Each housing of the rotary jet delivery assemblies 16 is provided with an upper open outlet end 32 having a peripheral edge 33 disposed substantially flush with one of the inner surfaces of the pool structure 10 and the exposed end 28 of housing 26 when its other end is threadedly attached to coupling 25 of conduit 17.

The open end of housing 26 may be provided with an inwardly extending flange 34 which individually or in combination with an O-ring 35 provides a substantially watertight connection or at least a dirt shield between the inside periphery of housing 26 and the outside periphery of housing 30.

As shown in FIG. 3, the peripheral edge 33 of housing 30 is provided with diagonally positioned key slots 36 for engaging the edge of a suitable tool (not shown) for threadedly attaching or removing housing 30 from coupling 25 in a well known manner.

Within housing 30 and slidable therewith for reciprocal motion therealong is a pair of cooperating hollow cylindrical head and piston members 37 and 38, respectively. Cylindrical member 38 is open at both of its ends 39 and 42 and is provided with a flange 40 extending outwardly thereof for engaging with an internal flange 41 mounted within the hollow interior of housing 30. Cylindrical member 37 is closed at its end 44 and arranged to telescopically fit over the outside of end 42 of cylindrical member 38 when both cylindrical members are fitted together in housing 30 as shown in FIG. 2.

Cylindrical members 37 and 38 are fitted together in a tight frictional manner or glued together, if so desired, to act when assembled in housing 30 as a unitary structure. To assemble them together cylindrical member 37 is pushed into housing 30 until its open end engages flange 41. Cylindrical member 38 is then pushed into the threaded end of housing 30 and into the open end of cylindrical member 37 until the end 42 of cylindrical member 38 engages a shelf or flange 48 formed around the inside periphery of cylindrical member 37.

Thus, when water pressure is applied to conduit 17 and in turn to the lower flat inner surface 43 of end 44 of cylindrical member 37, the unitary piston structure formed by cylindrical member 37 and 38 is driven outwardly of housing 30 until flange 40 of cylindrical member 38 engages the lower surface of flange 41 of housing 30. At this time the piston structure assumes the dash line position shown in FIG. 2.

The closed end 44 of cylindrical member 37 is of sufficient thickness such that a passageway 45 may be formed therein opening outwardly of the peripheral side of cylindrical member 37 and defining an exit port 46. Passageway 45 also opens inwardly of the hollow interior of cylindrical member 37 through surface 43 of its closed end 44 forming an inlet port 47.

It should be noted that passageway 45 is positioned to extend parallel with end 44 starting at inlet port 47 which is spaced from the axial center of cylindrical member 37 a given distance D and terminating in an exit or outlet port 46 spaced a given distance D' from the axial center of cylindrical member 37. This position of passageway 45 and its exit and inlet ports 46 and 47, respectively, aids in causing counterclockwise or clockwise rotation of cylindrical members 37 and 38 in housing 30 when water under pressure is ejected therefrom as hereinafter explained.

One working embodiment of the jet delivery assembly utilizes a two inch diameter cylindrical member 37 having a ¼ inch passageway 45 extending in a straight line about ½ inch from the longitudinal axis of cylindrical member 37. Cylindrical member 37 and 38 are also of sufficient weight such that under the action of gravity and the force of the pool water on the pool exposed surface of end 44 cylindrical member 37 will move into housing 30 when the water pressure in conduit 17 is interrupted.

The movement of the combined cylindrical members 37 and 38 into housing 30 under the action of gravity and/or the pressure of the pool water drives these members back into housing 30 toward its threaded end 24 until the lower end 37' of cylindrical member 37 engages flange 41 of housing 30 as shown in FIG. 2.

Cylindrical member 37 and particularly port 46 is adapted to issue a water jet, as indicated by arrows 49 parallel to or at an acute angle with the adjacent inner surface area of the pool surrounding the rotary water jet delivery assembly 16.

The water from the jet produced by port 46 of cylindrical member 37 forces upwardly and maintains in suspension in the water deletrious matter, such as fine silt, bugs, leaves, grass and other matter until eventually withdrawn from the pool through the main drain or skimmer of the pool structure by pump means 19. This deleterious matter is then collected in the filter and the clean water passes back through conduit 17 to further operate the rotary jet delivery assemblies 16. Each of these assemblies operates a jet stream nozzle or outlet port 46 disposed usually parallel to and in close adjacent relationship with the inner surfaces of the pool structure 10.

Each of the parts of the rotary jet delivery assemblies are displaced to issue a jet stream in parallel scrubbing relation with an inner surface of the pool structure 10 and in as much as the combined cylindrical members 37, 38 and are free to rotate throughout 360 degrees an entire area surrounding the jet delivery assembly may be cleaned by their rotation.

The rotating of the combined cylindrical members 37 and 38 are accomplished by the unique arrangement disclosed and claimed herein.

To cause the rotation of the piston structure formed by cylindrical members 37 and 38 in housing 30, the water pressure to the jet delivery assembly 16 is interrupted in a selected and predetermined manner. This function is provided by any suitable valving arrangement or pulser 31 which either temporarily interrupts the water flow under pressure to the jet delivery assemblies 16 or sequentially interrupts the flow of electrical current to the electric driven motor pump assembly 19 to stop and start the motor of the pump assembly. Since these pulser or motor interrupting means are known in the art, they will not be further described. It is believed sufficient for the purposes of this invention to state that the water periodically is interrupted to the jet delivery assembly.

It should be noted that each time the water pressure to the jet delivery assembly is interrupted the piston structure comprising the combined cylindrical members 37 and 38 will drop back or be forced into housing 30 at a different angular position within housing 30 from the position that it previously had occupied prior to the interruption of water pressure in conduit 17.

Rotation of the unitary structure formed by cylindrical members 37 and 38 relative to housing 30 occurs through the reaction of the pool water with the generation and/or interruption of the jet stream of water out of port 46 of cylindrical member 37. This starting and stopping of the jet stream of water out of port 46 of cylindrical member 37 causes the combined cylindrical members 37 and 38 to rotate an arcuate amount relative to housing 30. Since there is no mechanical connection between these combined cylindrical members 37 and 38 and housing 30, the amount of movement of them relative to housing 30 is a random amount depending, inter alia, on the water impulse in conduit 17, movement of pool water around the jet delivery assemblies etc. Nevertheless, each interruption of water pressure in conduit 17 results in a different but reasonably similar arcuate change in the position of the cylindrical members 37 and 38 relative to housing 30.

The cylindrical members 37 and 38 rotate during the time they move up to their extended position when water pressure is applied to the assembly and while these members are moving down into their housing when the water pressure to this assembly is interrupted. During their movement up or down in their housing, some water is being ejected from exit port 46 causing the cylindrical members to rotate. When in their fully extended position the cylindrical members 37 and 38 are locked in that position and do not rotate. When they are in their lower position and the water pressure is off they also do not rotate for lack of water pressure.

Thus, over a period of time a jet of water is caused to issue from outlet port 46 covering a 360 degree sweep of the interior pool surface around the various jet delivery assemblies.

Figure 4:
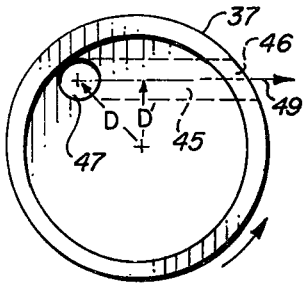
FIG. 4 is a bottom view of FIG. 5 showing a modification of the rotary jet producing nozzle or head shown in FIGS. 1–3.
Figure 5:
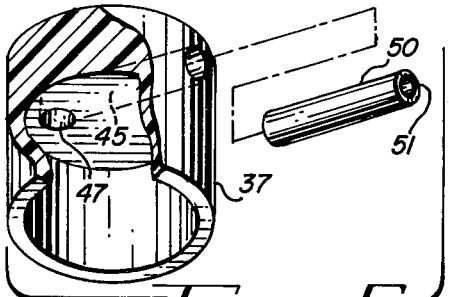
FIG. 5 is a partial perspective view illustrating a modification of the moveable portion of the jet producing head shown in FIGS. 1, 3 and 4.

FIGS. 4 and 5 disclose a modification of the jet delivery assembly shown in FIGS. 1–4 wherein the cylindrical member 37 is merely provided with an insert 50 for placement in passageway 45 so that a particular nozzle opening 51 may be provided. If desired, various openings 51 may be provided by drilling different size holes in end 44 of cylindrical member 37 in forming passageway 45.

It should be noted that the component parts of the rotatable pop-up water delivery head are shown in the drawing as formed of plastic materials, however, any one or all of the parts may be formed of other materials such as suitable metals and still fall within the scope of this invention.

Although but a few embodiments of the present invention have been illustrated and described, it will be apparent to those skilled in the art that various changes and modifications may be made therein without departing from the spirit of the invention or from the scope of the appended claims.

What is claimed is:

1. A rotatable pop-up water delivery head for swimming pool cleaning systems comprising:

a generally cylindrical open ended housing for connection to an inlet plumbing conduit communicating between said housing and a source of water under pressure, and a piston like means mounted in said housing for reciprocal movement longitudinally of said housing a predetermined distance by water pressure applied thereto from the conduit, said piston like means comprising an unrestrained randomly rotatable hollow cylindrical piston having an open lower end and a closed upper end, said closed upper end of said piston comprising a piston head defining a passageway extending therethrough with one end opening outwardly of said piston and defining an outlet port and the other end extending through the side of said piston head to a location exposed to water pressure from the conduit and defining a vertically extending water inlet port, said inlet port being formed in the closed upper end of said hollow cylindrical piston at a point spaced from and parallel with the longitudinal axis of said piston head, said passageway extending in a substantially straight line beginning at said inlet port and extending horizontally across the end of said head at a given distance from the longitudinal axis of said head, said outlet port projecting a pressurized stream of water in a direction laterally to the axis of rotation of said head and in substantially parallel and scrubbing relation to an inner surface of an associated pool wall when said piston like means is moved partially out of said other end of said housing exposing said outlet port to the interior of the associated swimming pool, said head upon interruption of water pressure to said housing moving back into said housing under the action of gravity on said head and assuming a different position with the interior of said housing than the position occupied when previously driven partially out of said housing, whereby the pressure of the water leaving the outlet port reacting on the pool water adjacent the head causing random rotational movement of the piston like means relative to the housing during its reciprocal movement in the housing.

2. The rotatable pop-up water delivery head set forth in claim 1 in further combination with:

an insert for positioning in said outlet port to vary the size of its orifice.

* * * * *